US008349110B1

(12) United States Patent
Kochis

(10) Patent No.: US 8,349,110 B1
(45) Date of Patent: Jan. 8, 2013

(54) METHOD TO APPLY TEXTURE TO A WALL SURFACE

(76) Inventor: John Kochis, Jacksonville, FL (US)

( * ) Notice: Subject to any disclaimer, the term of this patent is extended or adjusted under 35 U.S.C. 154(b) by 0 days.

(21) Appl. No.: 13/316,599

(22) Filed: Dec. 12, 2011

(51) Int. Cl.
*E04B 2/00* (2006.01)

(52) U.S. Cl. ..... 156/71

(58) Field of Classification Search ..... 156/71
See application file for complete search history.

(56) References Cited

U.S. PATENT DOCUMENTS

| | | | |
|---|---|---|---|
| 5,676,999 | A | 10/1997 | Silva |
| 5,934,518 | A | 8/1999 | Stern et al. |
| 6,913,407 | B2 | 7/2005 | Greer et al. |
| 7,278,590 | B1 | 10/2007 | Greer, Jr. et al. |
| 2002/0020328 | A1 | 2/2002 | Krenz |
| 2005/0161531 | A1 | 7/2005 | Greer, Jr. et al. |

*Primary Examiner* — Khanh P Nguyen
*Assistant Examiner* — Margaret Squalls
(74) *Attorney, Agent, or Firm* — Lawrence J. Gibney, Jr.

(57) ABSTRACT

Defects in walls need to be repaired and need to be repaired so that the wall does not appear to have had a defect in the wall. This is particularly difficult when texture is on the wall. This method will permit texture that appears on the wall to be transferred to the area being repaired with no distinction between the originally damaged area and the original texture of the wall.

3 Claims, 11 Drawing Sheets

METHOD TO APPLY TEXTURE TO A WALL SURFACE

BACKGROUND OF THE INVENTION

A. Field of the Invention

One of the difficulties in repairing walls is to match, on a consistent basis, the textured materials. The textured material can be as varied as the individual and it is important to get as close to the texture for cosmetic or aesthetic purposes.

B. Prior Art

There are many other types of devices in the prior art. which apply to textured materials, ceiling surfaces, and other wall surfaces. A representative example can be found at Western and Greer, U.S. Pat. No. 7,278,590. There is an aerosol system for dispensing textured materials on a horizontal surface. The current device is not an aerosol system. Other aerosol systems, however, do exist in the prior art including Stern, U.S. Pat. No. 5,934,518, and Greer, U.S. Pat. No. 6,913,407.

The Greer '407 reference is a tube with a resilient applicator for dispensing textured materials. Again, however, the tube contains the textured material and defines the container opening through which the textured material may flow. The sponge may be able to find the applicator surface of the sponge opening, which is applied much like shoe polish, but is different from the current system.

Other aerosol applications include Greer, U.S. Publication 2005/0161531, and Krens, U.S. Publication 2002/0020328.

BRIEF SUMMARY OF THE INVENTION

In the repair of a wall or ceiling surface in a home, it is important to match the texture of the wall as closely as possible for cosmetic purposes. This may be done by applying an aerosol treatment such as discussed in the prior art; however, these aerosols are very difficult to apply and tend to produce uneven results. Consequently, the use of an aerosol will inevitably not lead to an exact match. The texture is the pattern on a particular wall or ceiling surface.

The other applications that are found in the prior art that consist of using a tube will also not result in a perfect match because of the uneven application of the material.

This application is meant for the do-it-yourselfer with a small home project, which would be cost prohibitive to hire a repairman to make those corrections or repairs.

The first step is to prepare the wall surface that will be repaired; this preparation is needed prior to any repair to the wall.

Next a section on the textured wall that is close to the section that will be repaired is selected. Painter's tape is then placed around the textured portion of the wall. It is important to select an area close to the area that will be repaired because slightly different textures may appear on different walls.

Painter's tape is ideal for this application because it will not adhere to the paint on the wall.

Once the area has been taped off by the painter's tape a non-binding solution is placed on the interior of this area. The non-binding solution prevents the paint from peeling off the wall once the mold is peeled from the wall.

Once the non-binding solution has been applied, the patch compound is applied to the area and smoothed to an even finish. It should be a sufficient thickness so that it is thick enough to insure that it will come apart when peeled from the wall and not too thick to prevent the texture compound from running.

The patch compound is then peeled from the wall and a transfer compound is applied to the area to be repaired. The transfer compound is allowed to dry and that ordinarily takes about one hour.

The patch compound is then applied to the area that will be repaired and rolled onto the wall. The purpose of the rolling is to produce an even surface.

The patch compound is then peeled off the wall the area is sponged off to remove any excess material. The wall may then be painted if needed or desired.

DETAILED DESCRIPTION OF THE EMBODIMENTS

Numbering References

Figure 1:
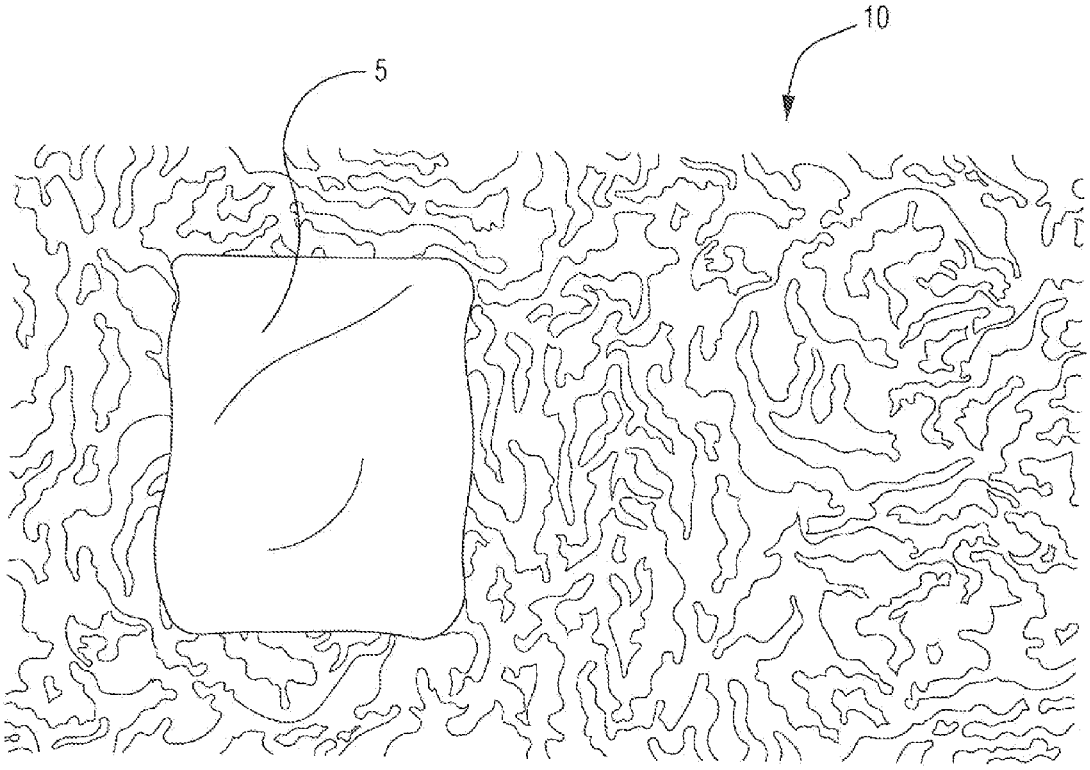
FIG. 1 depicts an area that is to be repaired on a textured wall.
Figure 2:
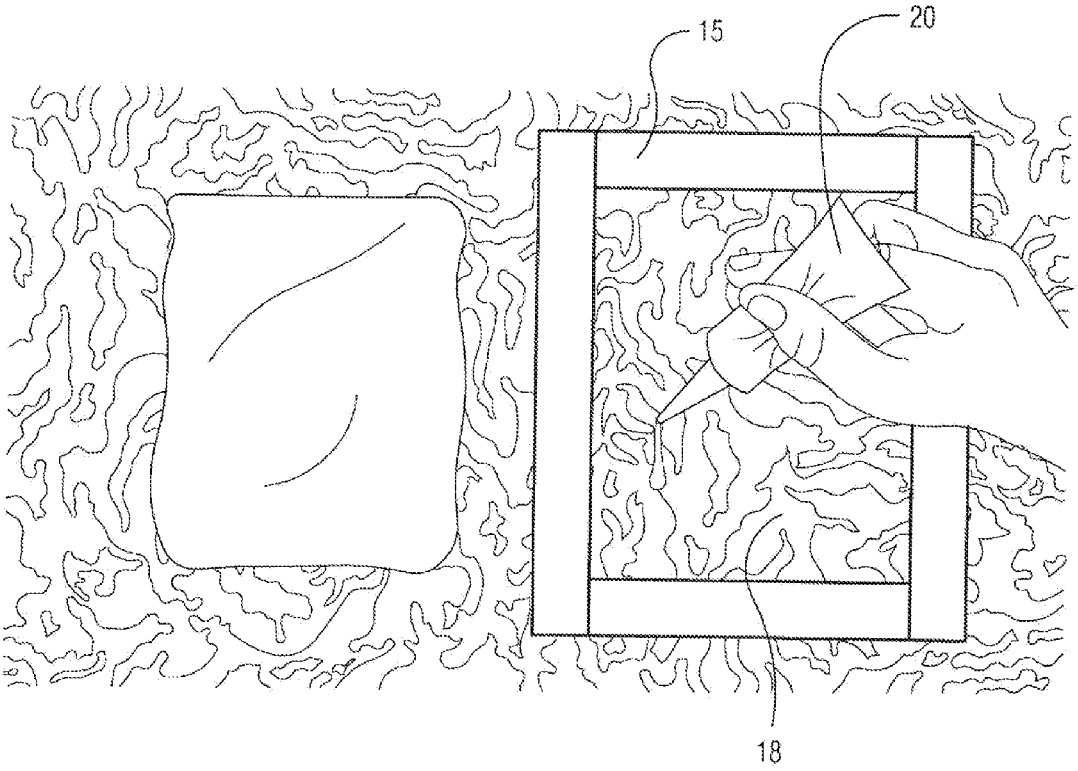
FIG. 2 is the application of the non-binding solution in an area framed by tape and adjacent to the area to be repaired.
Figure 3:
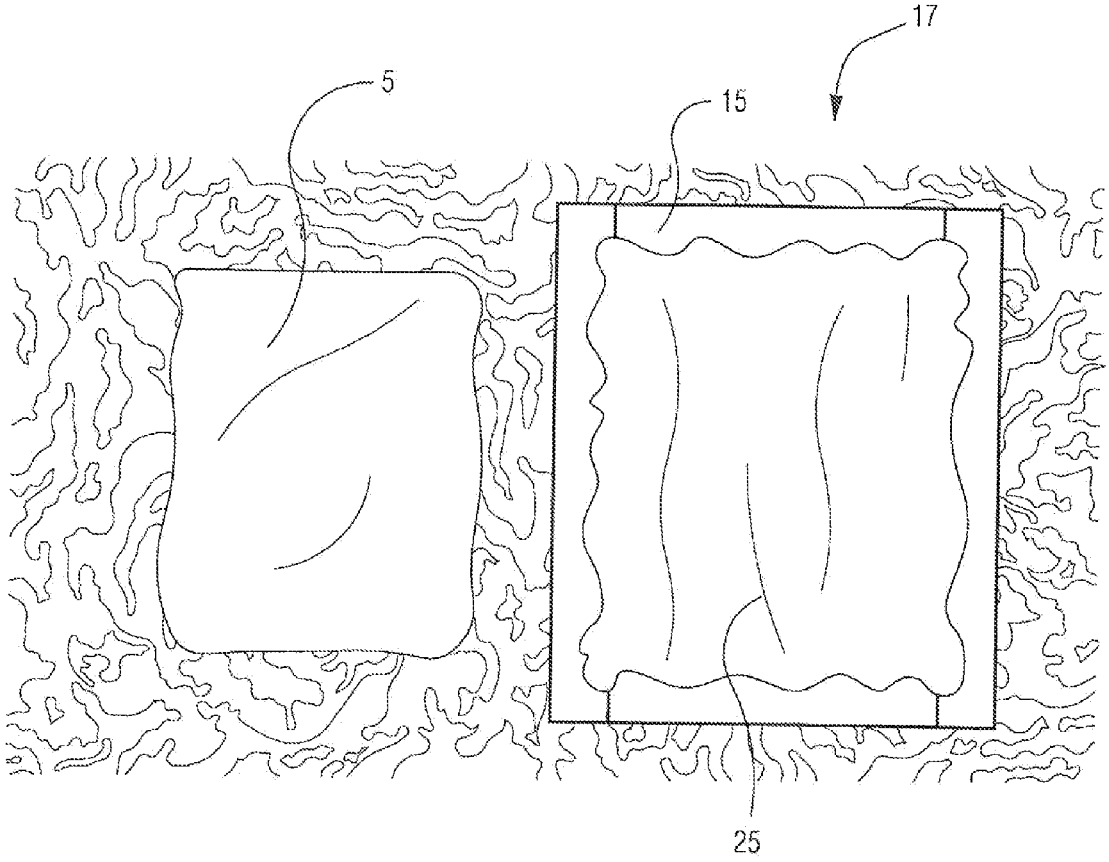
FIG. 3 is the patch compound placed over the textured portion of the wall.
Figure 4:
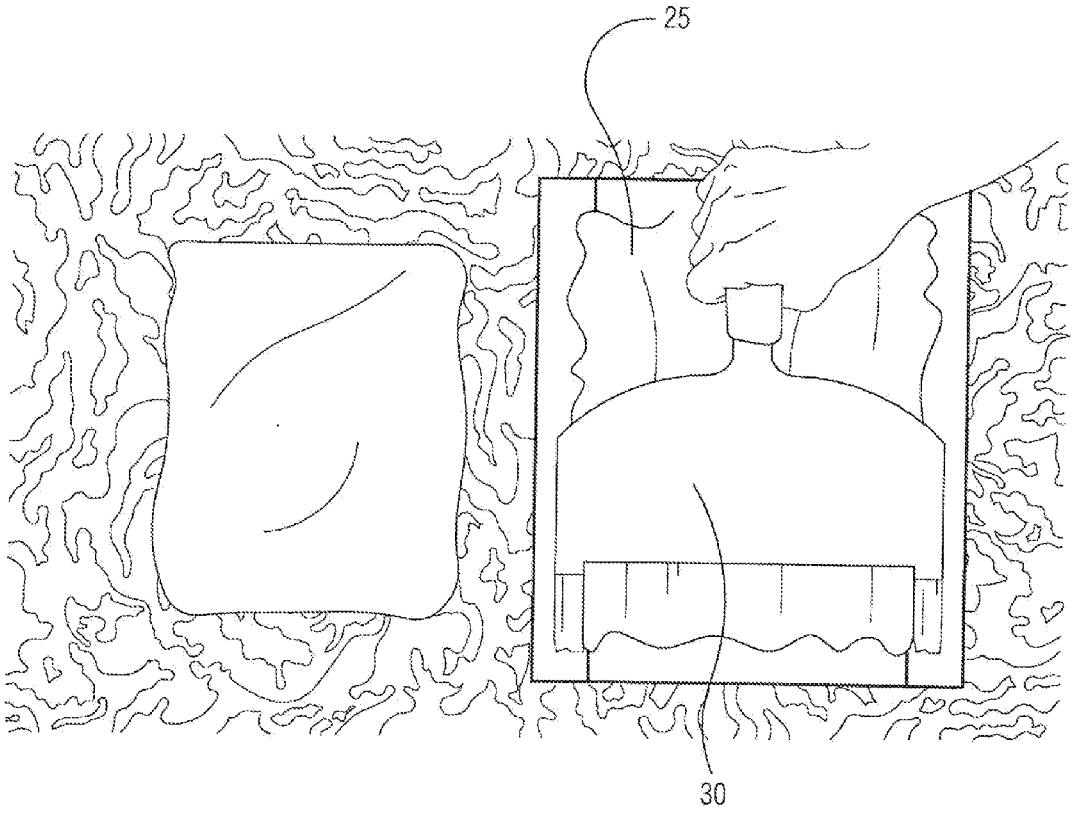
FIG. 4 is a depiction of the patch compound being scraped by a scraping tool to an appropriate thickness adjacent to the area to be repaired.
Figure 5:
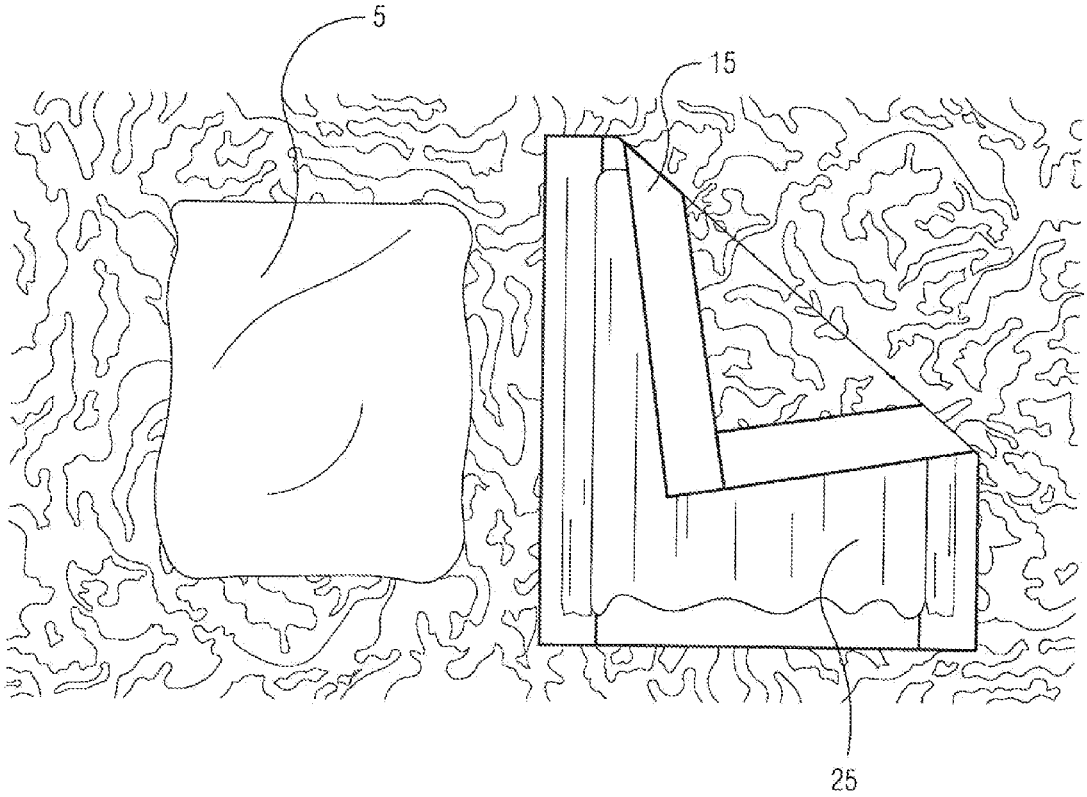
FIG. 5 is a depiction of the patch template once dry being peeled from the wall.
Figure 6:
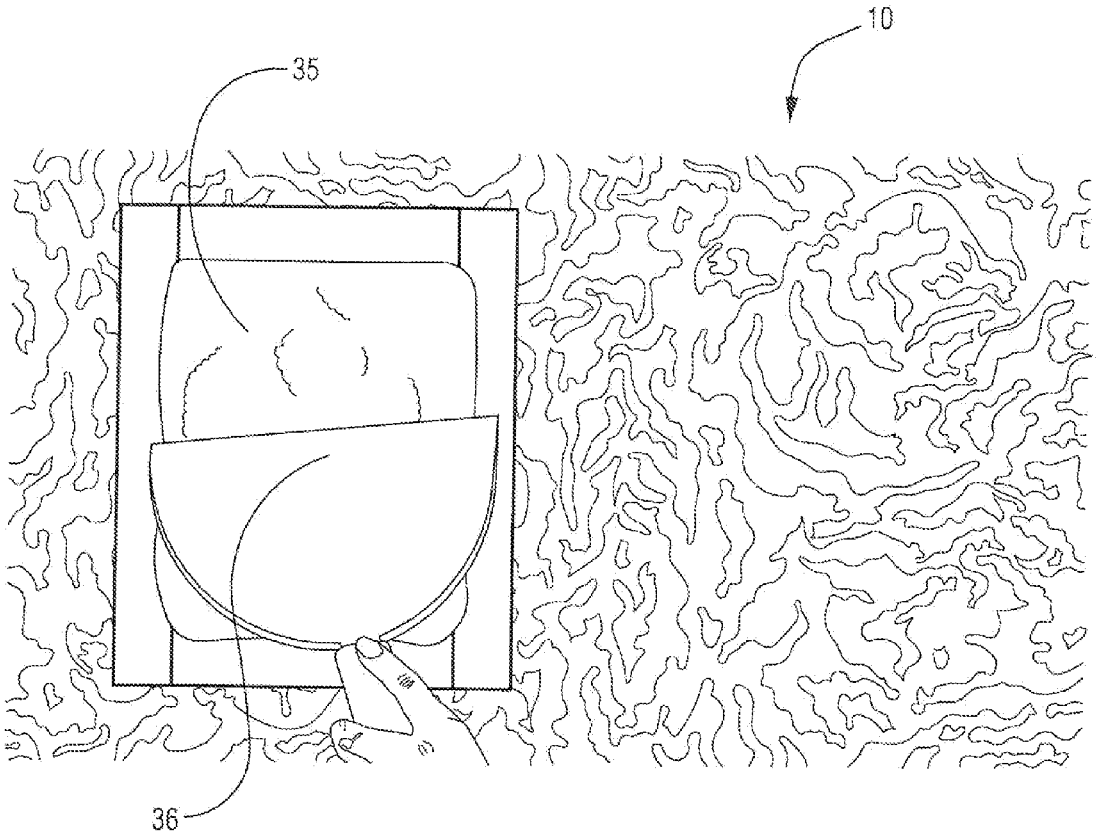
FIG. 6 is a depiction of transfer compound being applied and spread over the area to be repaired.
Figure 6A:
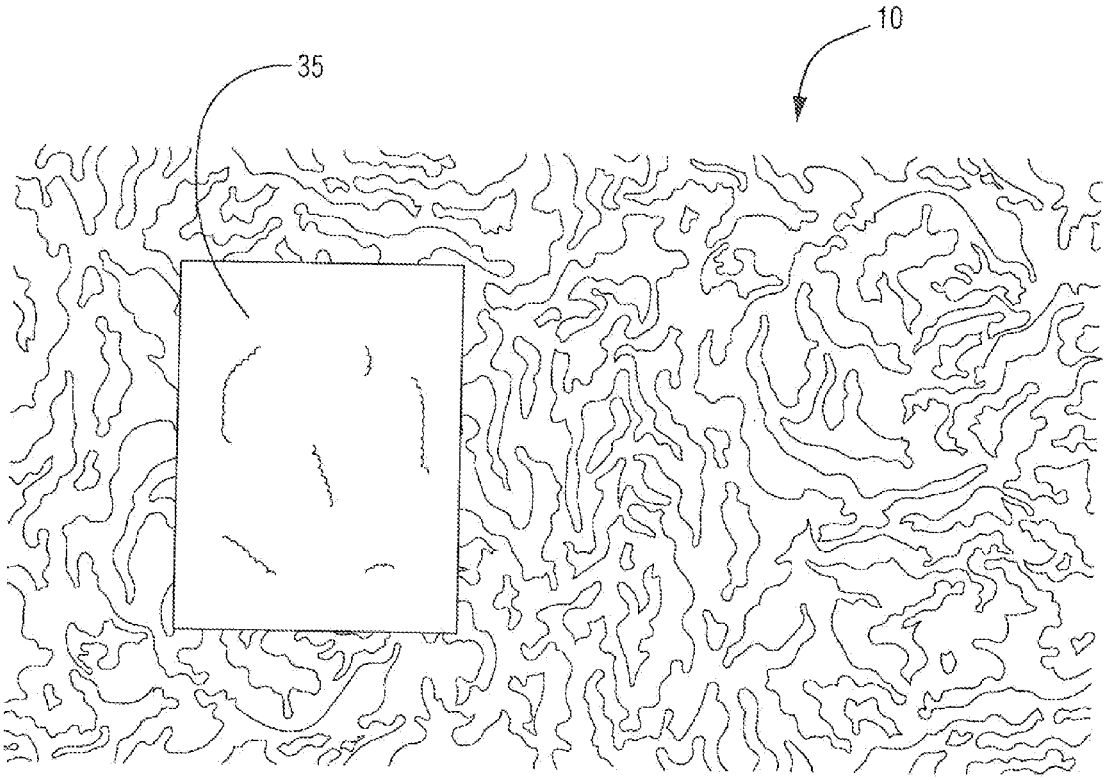
Figure 7:
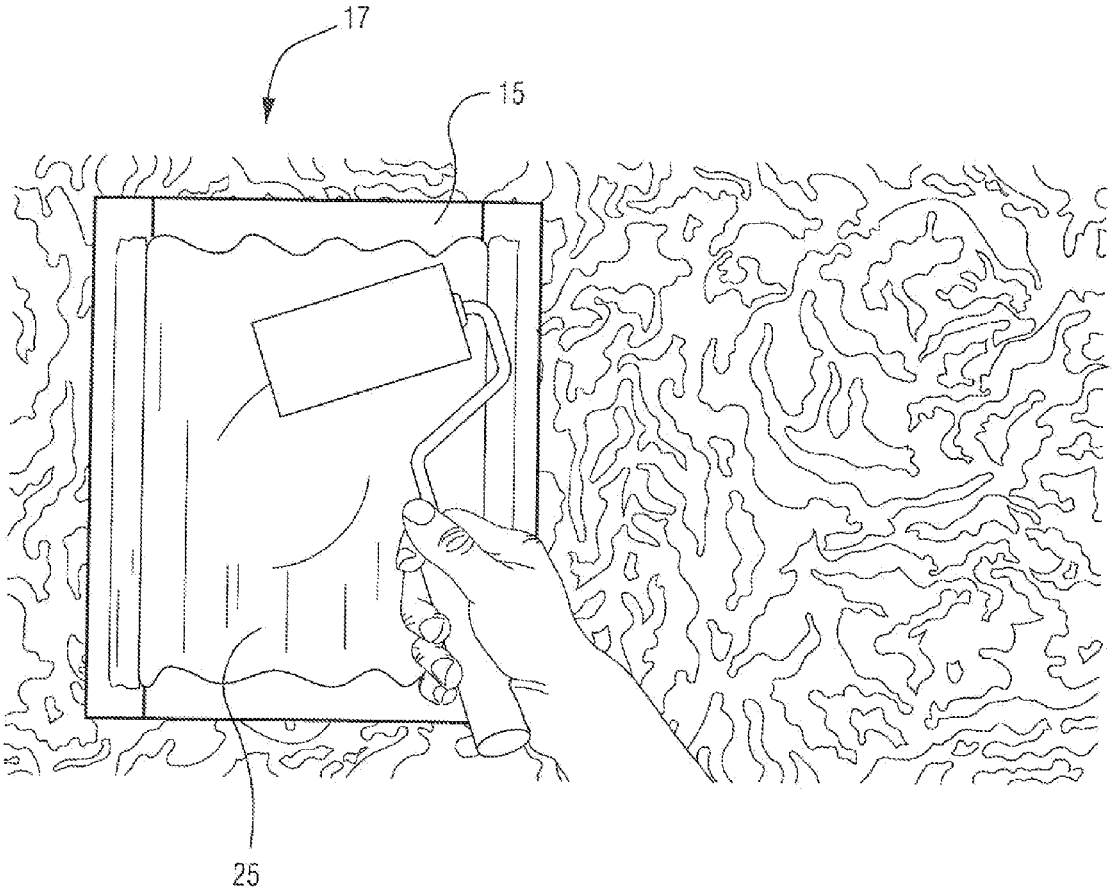
FIG. 7 is a depiction of the patch template being applied over the area to be repaired and rolled on to produce an even surface.
Figure 8:
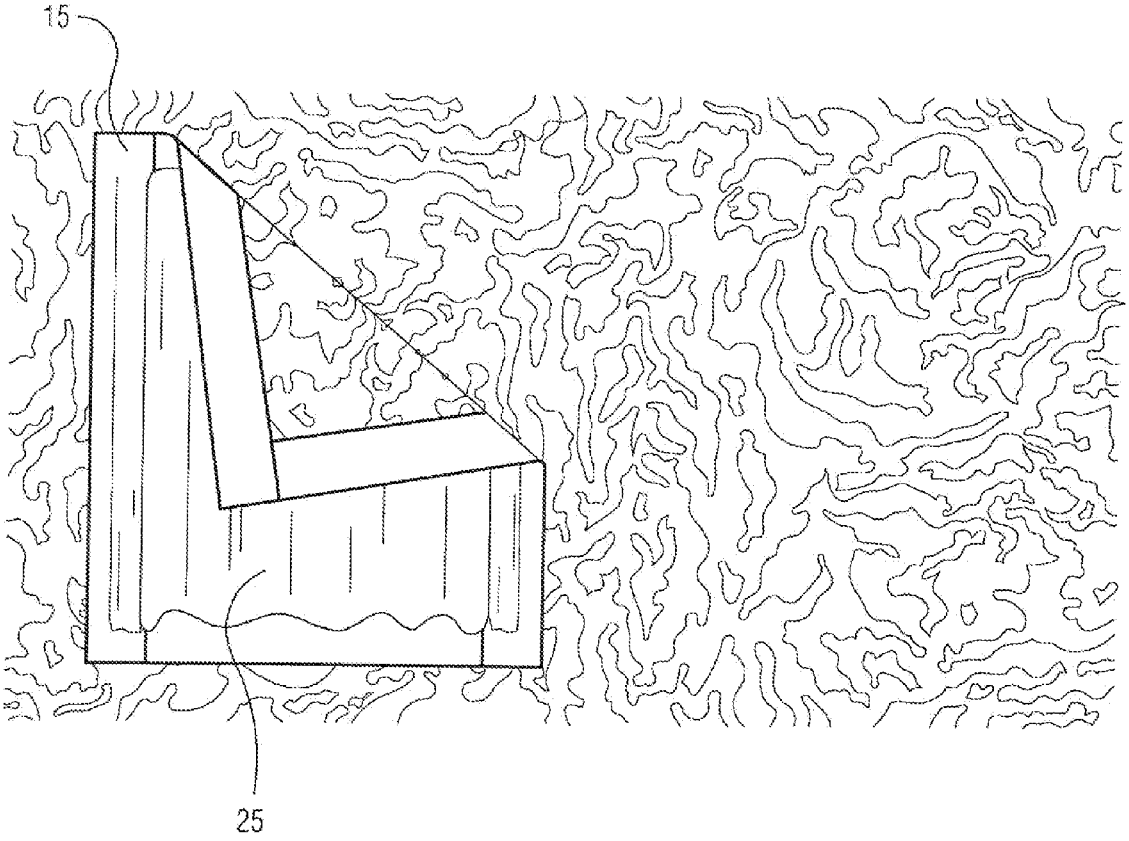
FIG. 8 is a depiction of the patch template being peeled from the area that has been repaired.
Figure 9:
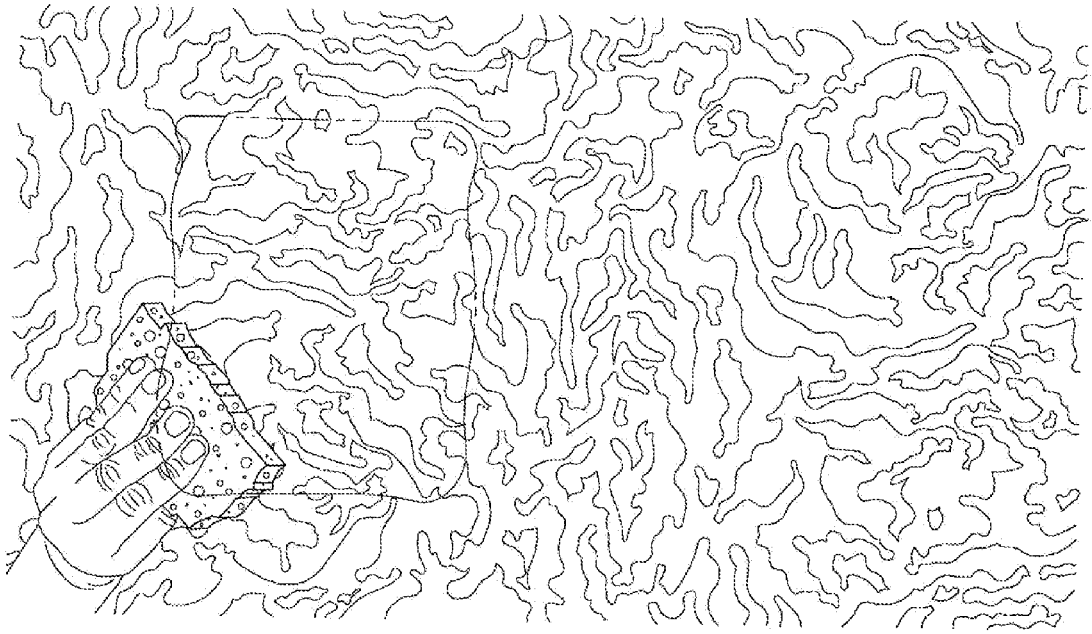
FIG. 9 is a depiction of the person sponging the area that has been repaired.
Figure 10:
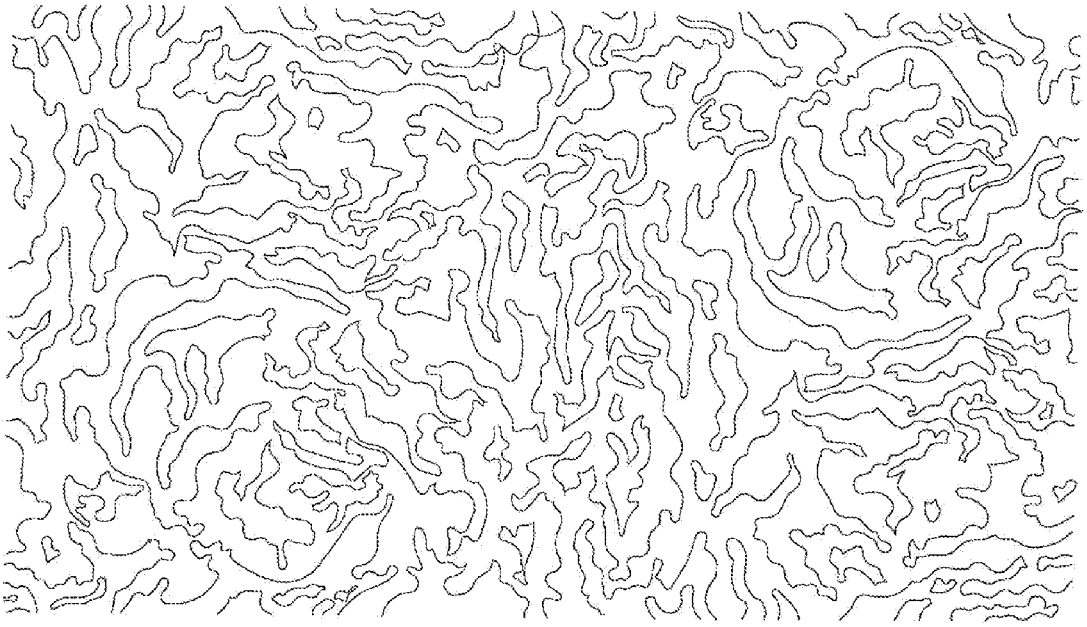
FIG. 10 is a depiction of the repaired area.

5 Area to be repaired
10 Textured Wall
15 Painter's Tape
17 Patch template
18 Transfer section
20 Non-binding compound
25 Patch compound
30 Scraping Tool
35 Transfer compound
36 Spreading Tool This is a method by which texture can be applied to a surface area of a wall that has been damaged. The texture of a wall is the pattern on the drywall after it has been painted and may include an "orange peel" texture or a "knock down" texture among others. These two types are the most commonly found and there may be other textures as well.

The need to repair a section of wall may occur because of a hole due to damage or damage to a wall over the course of time. Typically the area to be repaired is in the neighborhood of a four by eight section although smaller or larger sections may be repaired. Regardless of the size of the area to be repaired, it is important for cosmetic reasons to be able to duplicate the texture on the wall so that the wall surface 10 looks uniform and does not appear to be damaged in any way.

As depicted in FIG. 1, the area to be repaired 5 in the wall has been initially repaired so that a smooth drywall finish is present. As in most repair jobs, the wall surface should be clean and dry prior to any application.

The individual would then apply tape 15, probably painter's tape that will not stick to the wall to an area from which the transfer 18 will occur. The area from which the transfer 18 will be complete should be adjacent to the area to be repaired 5 to insure a uniform texture pattern.

A non-binding solution is then applied to the transfer section 18 and then the patch compound 25 is applied over the transfer area 18.

The patch compound 25 is smoothed with a smoothing tool 30 and then allowed to dry, probably in a range of sixteen to twenty-four hours. The smoothing tool is notched at the ends to insure that the patch compound stays within the confines of the area to be repaired. Ideally the thickness of the patch compound is between one-sixteenth and one-thirty-second of an inch.

The patch template 17 that is comprised of the painters' tape and the dried patch compound is then peeled from the transfer section.

Transfer compound 35 is applied to the area to be repaired with a smoothing tool such as an oversized putty knife 36. The purpose of using an oversized blade on the putty knife is to insure a relatively uniform application of transfer compound.

The patch template 17 is then applied over the area to be repaired and rolled on to produce and even surface. After an appropriate period of time the patch template 17 is removed and the area is sponged off with a slightly damp sponge to remove any excess material. Once the final sponging has been accomplished, the area can be painted if desired or needed and the texture in the area of the repaired portion of the wall should be identical to the original texture of the wall.

While the embodiments to the invention have been described, a person may modify the invention without departing from the spirit of the invention.

The inventor claims:

1. A method to apply texture to a wall which is comprised of the following steps:

a. preparing an area of a wall to be repaired;
b. selecting an area of textured wall that is adjacent to the area to be repaired
c. taping the textured section of wall;
d. applying a predetermined portion of non-binding solution over the area of the textured wall;
e. applying patch compound over the area of the textured wall;
f. smoothing the patch compound to a predetermined thickness;
g. permitting the patch compound to dry, creating a patch template;
h. peeling the patch template from the textured area
i. applying transfer compound over the area to be repaired;
j. smoothing the transfer compound;
k. applying the patch template upon the transfer compound which is over the area to be repaired;
l. rolling the patch template over the area to be repaired;
m. peeling the patch template from the area that has been repaired;
n. removing any excess material from the area that has been repaired;
o. painting the wall if desired.

2. The method as described in claim 1 wherein the time required to allow the patch compound to dry is between sixteen and twenty-four hours.

3. The method as described in claim 1 wherein the desired thickness of the patch compound is between one-sixteenth and one-thirty-second inch.

* * * * *